US005860765A

United States Patent [19]

Cruchelow et al.

[11] Patent Number: 5,860,765

[45] **Date of Patent: *Jan. 19, 1999**

[54] IN-WATER DRY DOCK SYSTEM WITH REMOVABLE CENTERLINE INSERT

[76] Inventors: Albert Cruchelow, 23103 Bayleaf, Spring, Tex. 77373; Rodney H. Masters, 15730 Sellers Rd., Houston, Tex. 77060

[ * ] Notice: The term of this patent shall not extend beyond the expiration date of Pat. No. 5,549,070.

[21] Appl. No.: 598,929

[22] Filed: Feb. 9, 1996

[51] Int. Cl.[6] ..... B63B 35/44

[52] U.S. Cl. ..... 405/4; 405/3; 405/7; 114/263; 114/52

[58] Field of Search ..... 405/1, 3, 4, 5, 405/7; 114/44–50, 52, 53, 263

[56] References Cited

U.S. PATENT DOCUMENTS

| | | | |
|---|---|---|---|
| 256,608 | 4/1882 | Watts | 114/45 X |
| 2,768,599 | 10/1956 | Harris . | |
| 3,133,518 | 5/1964 | Burnett . | |
| 3,688,719 | 9/1972 | Amirikian | 114/45 X |
| 3,976,022 | 8/1976 | Lapeyre . | |
| 4,510,877 | 4/1985 | Bloxham . | |
| 4,615,289 | 10/1986 | Bloxham . | |
| 4,691,656 | 9/1987 | Katernberg et al. | 114/45 |
| 5,138,963 | 8/1992 | Eichert . | |
| 5,140,922 | 8/1992 | Bowman et al. . | |
| 5,394,814 | 3/1995 | Rutter et al. | 114/45 |
| 5,549,070 | 8/1996 | Cruchelow et al. | 114/263 |

FOREIGN PATENT DOCUMENTS

| | | | |
|---|---|---|---|
| 534608 | 1/1955 | Belgium | 114/45 |
| 235649 | 6/1911 | Germany | 114/46 |
| 3340905 | 5/1985 | Germany | 405/4 |
| 1175794 | 8/1985 | U.S.S.R. | 114/47 |

*Primary Examiner*—Tamara L. Graysay
*Assistant Examiner*—Frederick L. Lagman
*Attorney, Agent, or Firm*—Gunn & Associates, P.C.

[57] ABSTRACT

The present invention provides a simple system for in-water dry docking pleasure boats using existing boat slips. The system includes a dry-dock basin having one or more ballast tanks mounted below the bottom surface of the basin. The basin is submerged along guide pipes below the boat slip where the boat is typically stored. The basin comprises a port hull half and a starboard hull half that abuttingly engage at a seam which preferably comprises an insert. The insert is preferably flexible and may be formed as a keel well.

15 Claims, 9 Drawing Sheets

29
32
12
16
30a
10
30
15
17
14
26
19
54
16
28
24
18
20
22
27

IN-WATER DRY DOCK SYSTEM WITH REMOVABLE CENTERLINE INSERT

FIELD OF THE INVENTION

The present invention relates generally to the field of dry docks for storing watercraft and/or for use in performing maintenance and repairs on pleasure craft and other small boats and, more particularly, to a method and apparatus for dry docking boats using existing boat slips typically found in marinas, including a flexible and removable joint that assists in the overland transportation of the dry dock as well as providing a means of absorbing the crushing force of ice formed around the dry dock in northern freezing climates.

BACKGROUND OF THE INVENTION

A boat hull requires periodic preventive and corrective maintenance to remove accumulated algae, organisms, and general dirt and other extraneous matter. The portion of a hull above the waterline is subject to other kinds of deterioration during normal operation of the craft, especially in a salt water environment, and this upper portion of a hull also requires occasional maintenance.

An owner of a pleasure craft may rent or own a boat slip in which to store his boat between outings. He may also own or have access to a hoisting assembly which typically is made of a hoist, cables, and slings to lift his boat out of the water for maintenance and repairs or simply to store the boat. By storing the boat out of the water, not only is the boat more easily maintained, it is also subjected to less attack from the elements and therefore requires less maintenance.

Large boats are more difficult to lift out of the water than smaller boats. To avoid the difficulty and expense (and possible damage to their boats) in routinely removing their boats from the water between outings, many owners of boats longer than 25 feet leave their boats in the water, typically at a marina, and periodically dry dock their boats at a commercial facility for periodic repair, painting, and other maintenance.

Commercial dry dock facilities are commonly of the submersible type. To dry dock a boat, the operator of the facility uses a relatively complex apparatus to submerge the dry dock, the craft is placed in position under its own power or by towing, and the submersible dry dock is lifted to lift the craft out of the water. Most submersible dry docks include various mechanisms such as doors, hydraulic or pneumatic cylinders, and other mechanisms. In addition to being expensive, such dry docks are subject to breakdown like any complex mechanical device.

For pleasure craft, owners or marine maintenance workers typically lift the boat out with a crane or hoist system, and set the boat on land on pods for support, where maintenance may be performed.

Other facilities simply lift the pleasure craft out of the water using a crane, hoist, or the like and transfer the vessel onto support pedestals where maintenance work is performed.

Consequently, there remains a need for a simple, affordable, dry dock apparatus that will allow the owners of relatively shallow-draft pleasure craft to reduce their maintenance costs, perform needed maintenance, and generally secure their boats on a routine basis without significant structural modifications to existing storage facilities such as marinas.

During further development of the invention disclosed in the above-mentioned application Ser. No. 08/294,253 now U.S. Pat. No. 5,549,070, it has been found that overland shipment of dry-dock can be simplified in certain circumstances by forming the dry-dock from two mirror-image halves. The whole dry-dock, formed as a single molding may present difficulties as a wide load in highway transit, and particularly in marina areas. There thus remains a need for a dry-dock that can be formed of mirror image halves that are easily assembled at the site of use, thus eliminating the "wide load" problem.

In northern freezing climates, pleasure craft are typically removed from the water because water expands as it freezes. This expansion creates extremely high crushing pressures on the hulls of the pleasure craft. Dry-docks may also find use in these freezing waters at the most beneficial time, the time in which the pleasure craft are removed from the freezing waters to protect them from the crushing ice forces. Thus, there remains a need for a means of absorbing the pressures exerted by frozen water surrounding the dry-dock.

SUMMARY OF THE INVENTION

The present invention solves these and other drawbacks in the prior art. This simplified dry docking system of the present invention is intended to be used at the boat owner's boat stall or slip. It can be installed into an existing structure with little or no structural modifications to the dock or overhead support structure. No loads are applied to the dock or marina structure. Further, no overhead structure is required in the use or implementation of the present invention as in known dry docks. Since the dry dock system and method of the present invention is simple and compact, it is relatively inexpensive and places dry docking capabilities into the hands of the average boating enthusiast.

The present invention is a simplified system for in-water dry docking pleasure boats using existing boat slips. It is particularly useful for pleasure boats 35 feet or more in length but is equally usable for smaller boats, including outboard and inboard power boats and sailboats with solid keels. The system includes a dry-dock basin having a pair or sets of ballast tanks mounted below the bottom surface of the basin. The basin is raised and lowered along guide pipes alongside and extending below the boat slip where the boat is typically stored. These guide pipes can be either driven into the soil beneath the boat slip, or in the case of a flood control reservoir where the water level fluctuates significantly, the guide pipes can attached to a floating structure.

While this system is suitable for any size boat, it is particularly suitable for larger boats which are difficult to hoist out of the water, typically greater than 35 feet in overall length. When the boat is positioned in the boat slip and the dry dock system is submerged and resting on or near the mudline, the tanks of the dry dock system are totally de-ballasted so that the basin rises up to engage the boat. A plurality of pads, preferably but not necessarily anti-fouling pads, engage the bottom of the boat and hold it within the basin of the dry dock.

One feature of this invention provides that the ballast tanks are not sized to lift the boat out of the water. The ballast tanks develop enough buoyancy capacity to allow the basin of the dry dock to rise in the water to such a point that contact is made with the bottom of the boat positioned in the slip. The basin is designed such that, when this contact is made, the sides of the dry dock basin are above water or the gunwales are penetrating the waterline. The water within the basin is then pumped out and the boat is now totally dry docked, using the dry dock as the flotation medium. Thus, this apparatus provides a simple solution for private boat owners to dry dock their boats on a routine basis.

The present invention is easily adaptable to mounting to a solid pier. Accommodation may also be made to the use of fresh water in the ballast tanks, in areas where ambient water may foul the interior of the ballast tanks. The structure of the present invention may also be adapted for the use of sailboats with fixed keels.

The present invention also provides a mid-line separation seam that may be releasably secured together as by bolting or other appropriate means. The mid-line separation seam permits the dry-dock to be formed of two mirror image halves, easily transported and manipulated as smaller pieces, and assembled on-site. The mid-line separation seam may further be an insert that is also releasably secured to the hull halves. The insert may be removed, and the hull halves secured directly together to adapt the dry-dock to narrower boats, such as "cigarette" boats. The insert may be further adapted to form a well to accommodate a boat with a keel. Finally, the insert may be formed of a flexible, polymeric material to permit the dry-dock to absorb the crushing forces of surrounding ice. In any combination, the assembled parts or halves comprise the "basin" of the dry-dock system.

These and other objects and features of the present invention will be immediately apparent to those of skill in the art as they read the following detailed description along with the drawing figures.

DETAILED DESCRIPTION OF A PREFERRED EMBODIMENT

The present invention is broadly applicable to salt-water and fresh-water dry docking of water craft; however, the preferred embodiment envisions using dock slips typically found in marinas and other storage facilities for pleasure craft. It should also be understood that the following detailed description includes a pneumatic control system depicted in FIG. 10, the presently preferred embodiment of the ballasting system that is a part of the present invention. However, the hydraulic ballasting system depicted in U.S. patent application Ser. No. 08/294,253 now U.S. Pat. No. 5,549,070 entitled IN-WATER DRY DOCK SYSTEM, is equally applicable to the present invention and this entire application is incorporated herein by reference.

Figure 1:
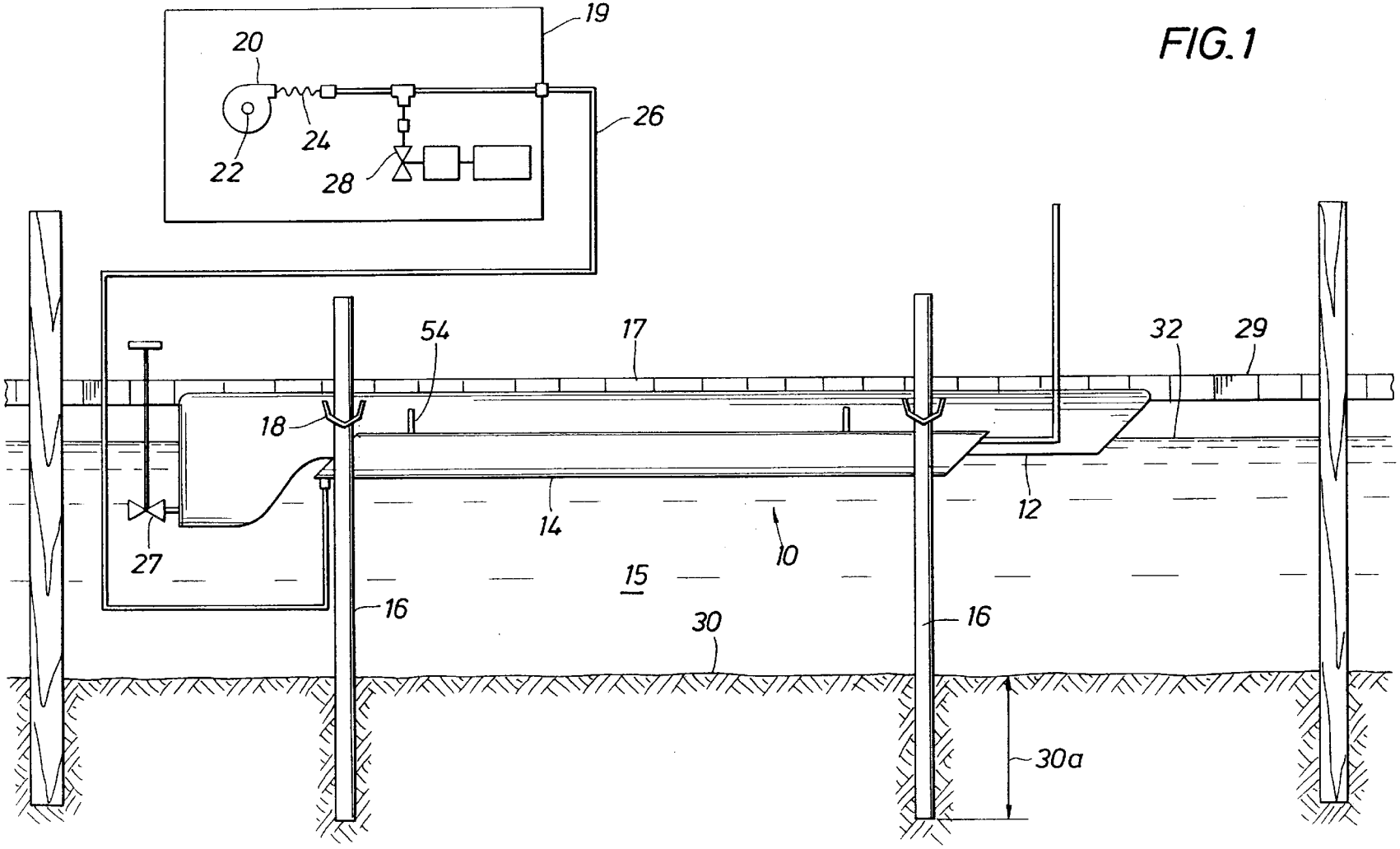
FIG. 1 is a side view of the dry dock system in a floating empty condition.
Figure 10:
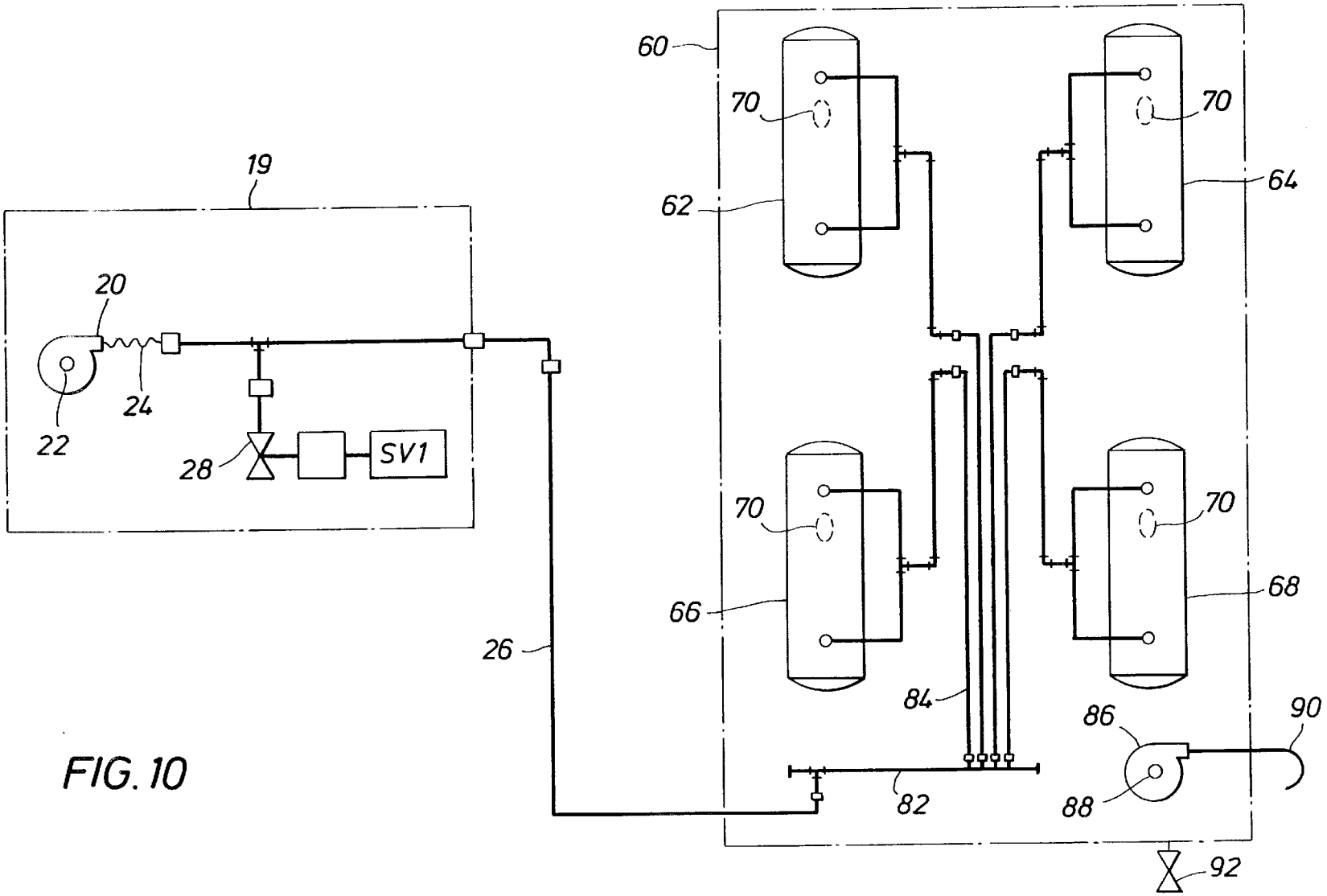
FIG. 10 is a schematic diagram of the ballasting flow systems for operation of the present invention.

As shown in FIG. 1, a dry dock system 10 includes a unitary basin 12, a ballast tank 14 on each side of the basin 12, guide pins 16 alongside the basin 12, and guide brackets 18 attached to the basin 12. The ballast tanks 14 may be provided with counter-flooding channels so that providing ballast to one tank 14 fills both tanks equally. Preferably, the ballasting system includes forward and after, port and starboard tanks 62, 64, 66, and 68, as shown in FIG. 10, described below in greater detail.

For ballasting and de-ballasting the dry dock system, a water control sub-system 19 includes a fan or blower 20, with an air intake 22. The discharge of the blower 20 is coupled to a flexible hose 24, and ultimately overboard to a flexible hose connection 26 to couple to the dry dock system 10. The sub-system 19 further includes a normally-closed, solenoid-operated valve 28 that provides remote control on the ballasting/de-ballasting system. For example, with the blower 20 off, remotely opening the valve 28 vents air from the tanks 62, 64, 66, and 68, (FIG. 10) thus sinking the dry-dock 10. The sub-system 19 is shown schematically in FIG. 1 and may be located anywhere convenient to the system.

For initial installation of the dry dock system 10, the basin 12 and associated apparatus is floated into a dock slip 29 in a typical marina and positioned in an appropriate location, as shown in FIG. 1. While the basin 12 is held in that position, the guide pins 16 are driven through the guide brackets 18 into the bottom 30 below a body of water.

Alternatively, the guide pins 16 can be fixedly attached to the dock slip 29, such as a floating or fixed marina. This feature is particularly useful in areas with widely varying water depth, such as during flood or drought conditions. If driven into the bottom, a depth 30*a* of the guide pins 16 into the bottom 30 may vary according to the specific application of the present invention.

The blower 20 is located in a convenient location, whether on the basin 12, pier-side, or placed in a remote location. The coupling hose 26 is preferably made of flexible hose and attached to the sub-system 19 with sufficient length to allow the dry dock system 10 to be lowered to the bottom 30.

Referring now to FIG. 10, the presently preferred embodiment for ballasting and de-ballasting is depicted. FIG. 10 is intended to diagramatically depict various aspects of a preferred embodiment of the present invention and is not necessarily to scale. A hull or basin limit 60 defines the maximum extent of the outside extremities of the dry dock system 10, particularly the basin. FIG. 10 also includes a plurality of ballast tanks 62, 64, 66, and 68. Ballast tanks 62 and 64 are the forward ballast tanks and ballast tanks 66 and 68 are the after ballast tanks. Placing the ballast tanks separated fore and aft provides improved control of the horizontal aspect of the dry dock system as the basin is raised and lowered for improved stability.

Each of the ballast tanks, 62, 64, 66, and 68 is provided with at least one bottom blow-hole 70, and preferably at least two such blow-holes. Each blow-hole is covered with a screen to keep the interior of the ballast tank relatively clean and to keep marine life out of the tanks. The blow-holes 70 are located on the bottom of the ballast tanks so that, when the ballast tanks have been filled with air, any additional air pumped into the tanks will be vented out the bottom. Further, when air is vented from the tanks, water is then permitted to flow into the bottom of the tanks.

The ballasting/de-ballasting system of FIG. 10 comprises the pier-side system 19 and portions within the boundaries of the hull limit 60. The system 19 includes the fan or blower 20 with the air intake 22. The discharge of the blower 20 is coupled to the flexible hose 24, and ultimately overboard to a hose connection 26. The system 71 further includes the normally-closed, solenoid-operated valve 28 that provides remote control on the ballasting/de-ballasting system.

The hose connection 26 couples to the on-board portion of the ballasting system at a manifold 82. The manifold provides air flow to a plurality of hoses 84, preferably one hose for each of the ballast tanks. However, a single line may be used with separate lines leading from this single line to each ballast tank. The hoses 84 are carefully sized and configured to that each is about the same length; this way, each carries about the same air flow to the ballast tanks and the ballast tanks are thus de-ballasted at the same rate. This feature of the present invention enables the remote control of the pneumatic system through the single control valve 28.

The system also includes a pump 86 to pump water out of the basin, as previously described. The pump 86 is provided with a suction connection 88 and an overboard discharge 90. A valve 92 provides a means for flooding the dry dock.

Returning to FIG. 1, to lower the dry dock system for entry of a boat into the system, water is first flooded into the basin 12 from the water 15 surrounding the system via a flood valve 27, which may be remotely operated. This lowers the system until an upper edge 17 of the basin is just above water, for example 1–2" above water. Next, air is vented from each ballast tank or the ballast tank system 14 by opening the solenoid operated valve 28. It will be understood by those of skill in the art that this sequence may also be reversed. The ballast tanks are flooded equally so that the basin remains level. The reduced buoyancy of the ballast tanks 14 lowers the basin 12 and determines the overall buoyancy of the system. Therefore, control of the sinking of the dry dock is provided by the ballast tanks. It is important to note that flooding the ballast tanks alone or the basin alone does not cause the system to sink to the mudline.

Figure 2:
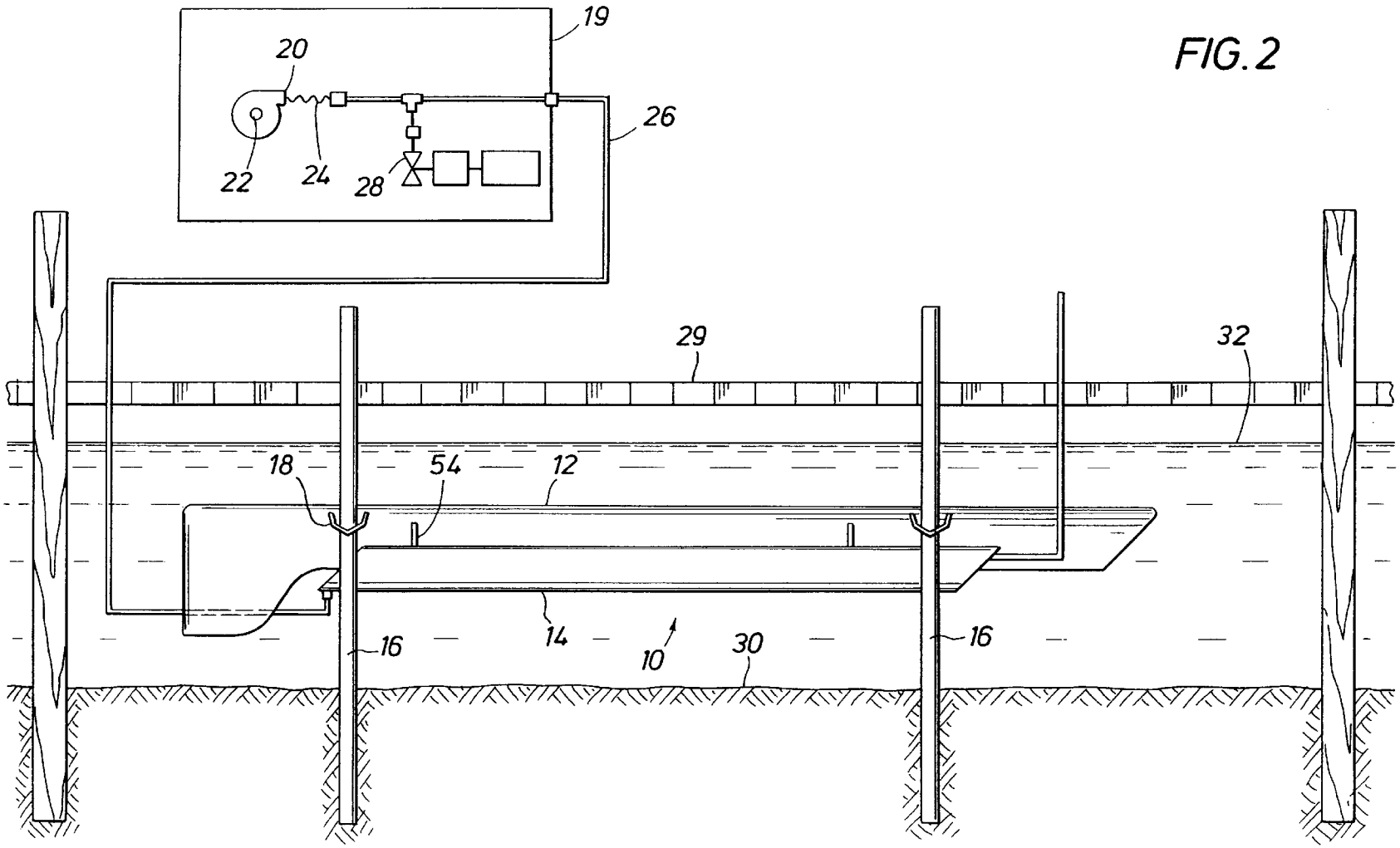
FIG. 2 is a side view of the dry dock system in an intermediate descending position.
Figure 3:
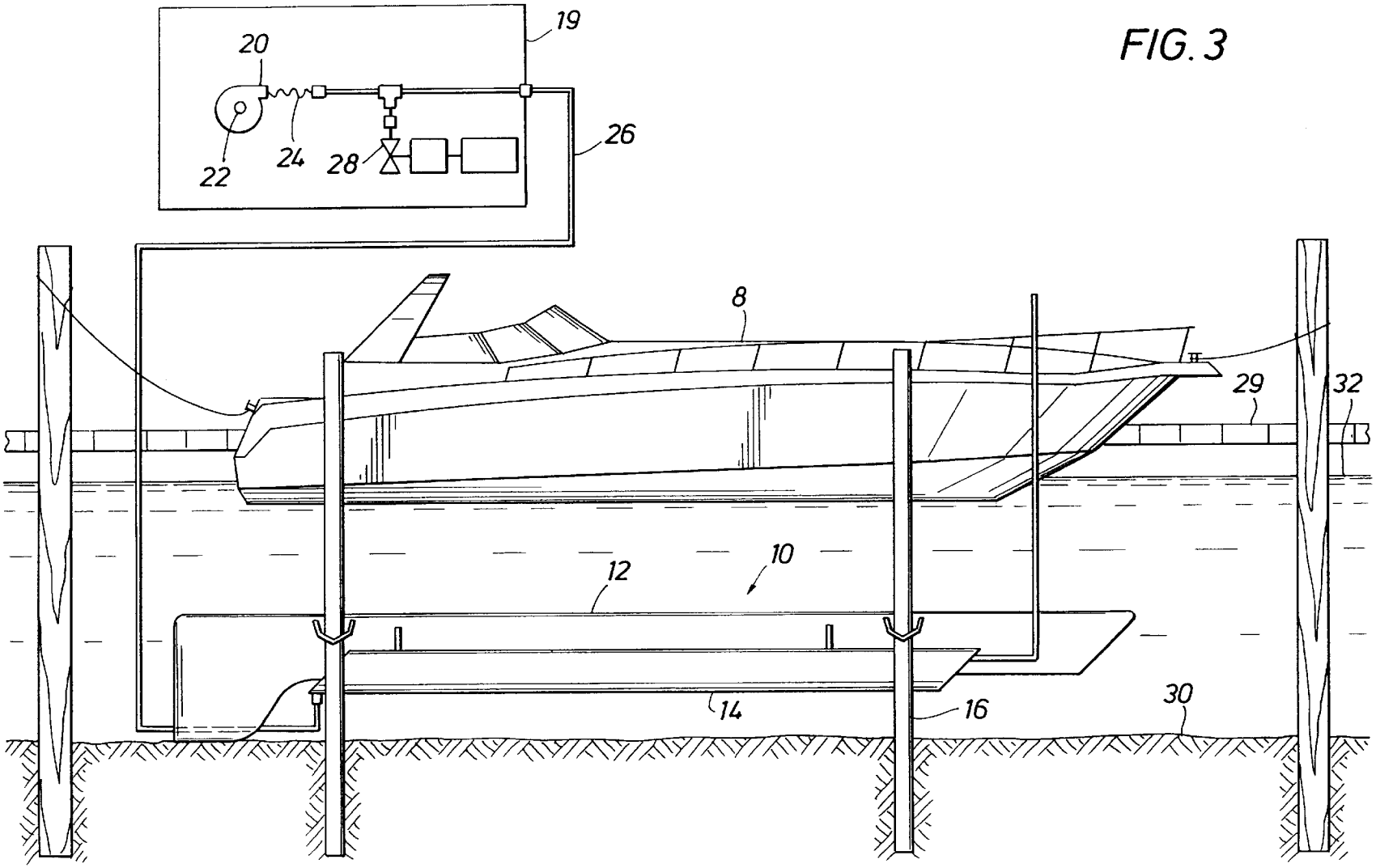
FIG. 3 is a side view of the dry docking system in a resting submerged position with a boat floating in the dock slip.

FIG. 2 depicts the dry dock system in a partially submerged condition. At this state, the ballast tanks and the basin are all full of water. This action completely submerges the dry dock system 10 until it comes to rest at a stop located along the guide pins, or on the bottom 30, as shown in FIG. 3. However, the system need not be submerged all of the way to the bottom, so long as it is lowered enough to allow a boat to enter the submerged dry dock. A boat 8 is then pulled into the dock slip 28 and secured, as shown in FIG. 3.

Figure 4:
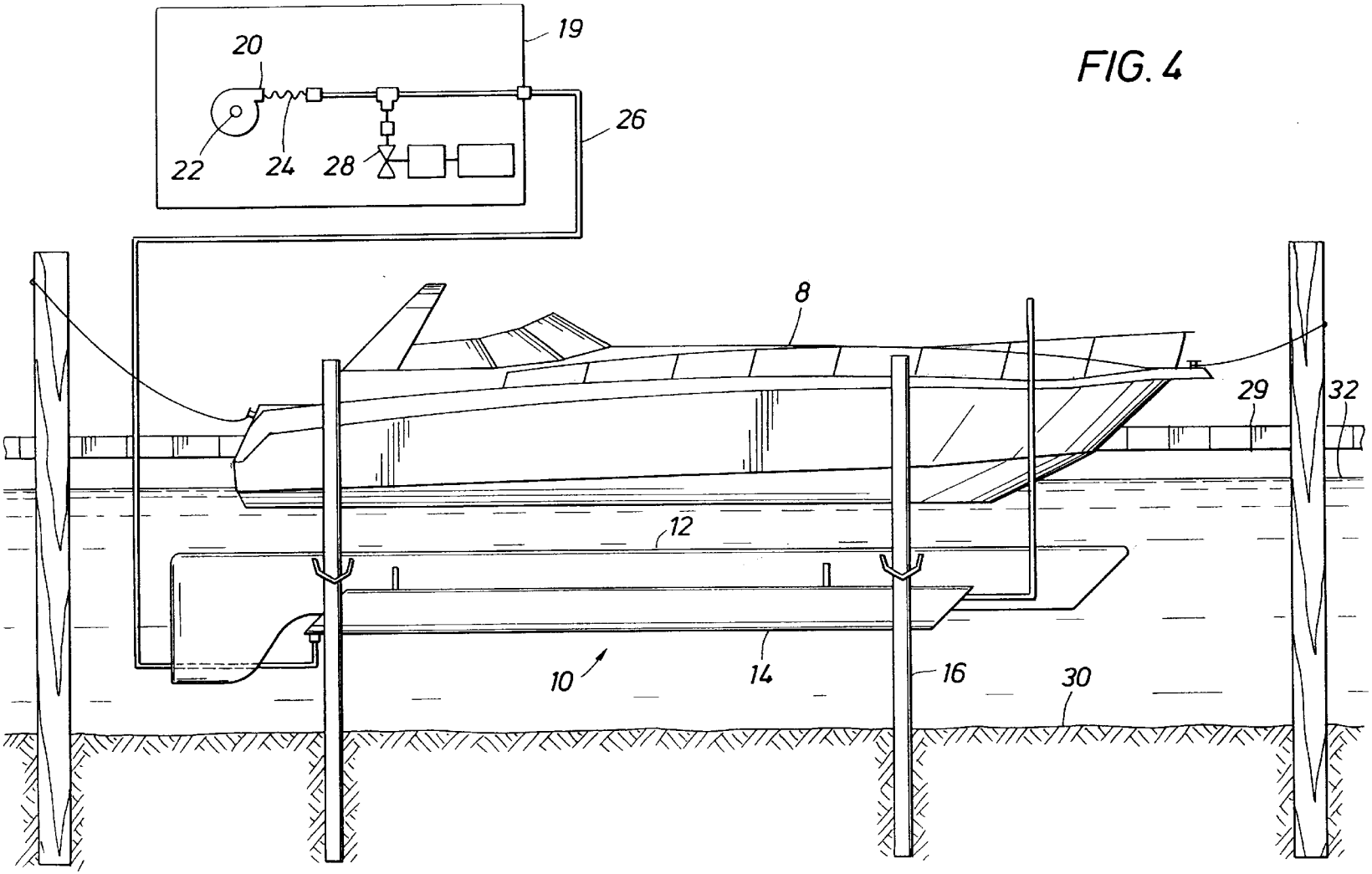
FIG. 4 is a side view of the dry dock system in an intermediate rising or ascending position.
Figure 5:
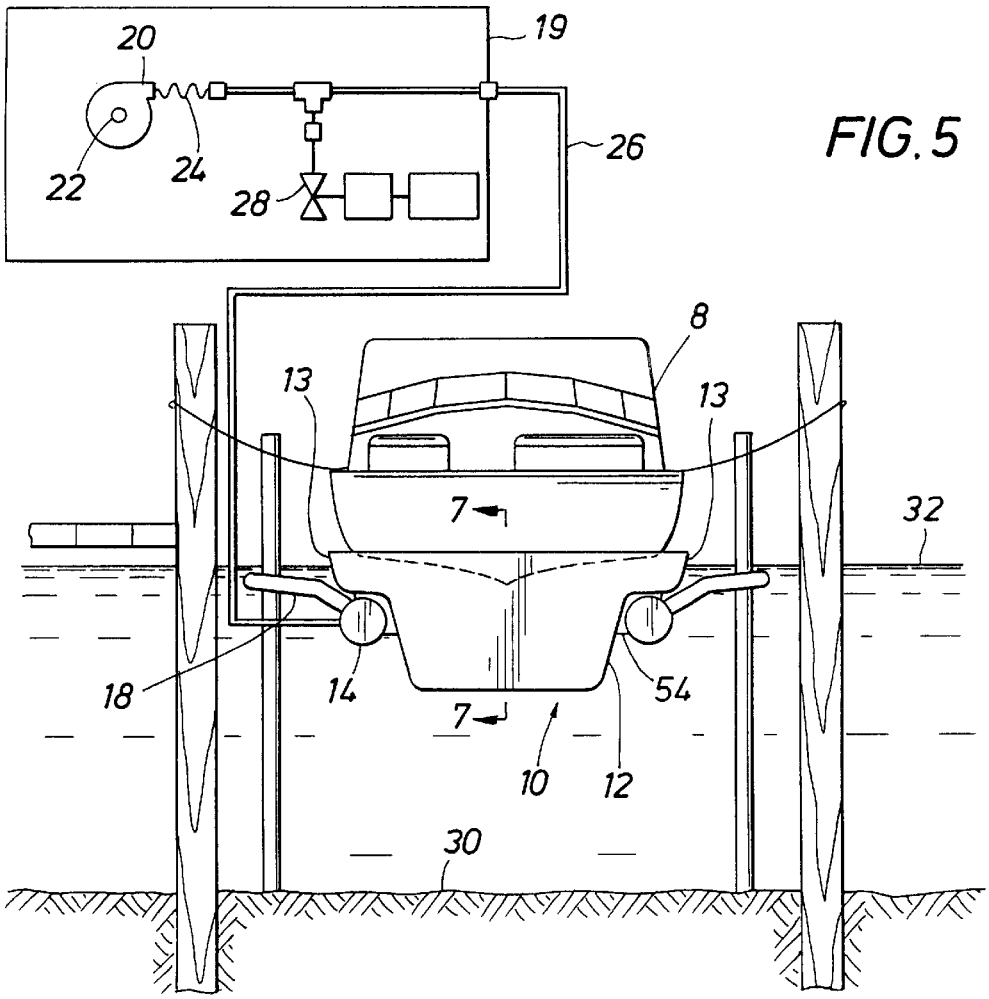
FIG. 5 is an end view of the dry docking system at a point when the basin has initially contacted the bottom of the boat, with the sides of the basin having penetrated the water level.
Figure 12:
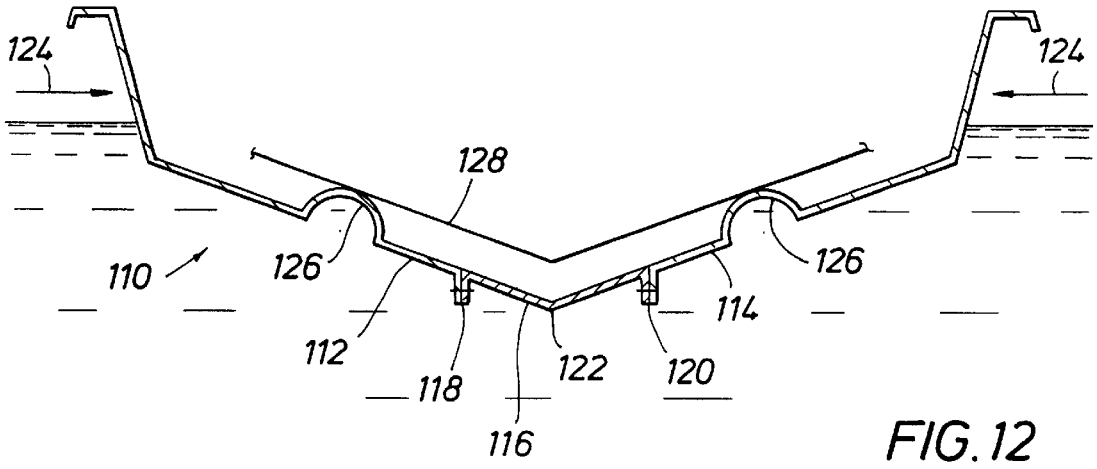
FIG. 12 is a section view of the present invention including a mid-line separation seam comprising a removable insert.
Figure 13:
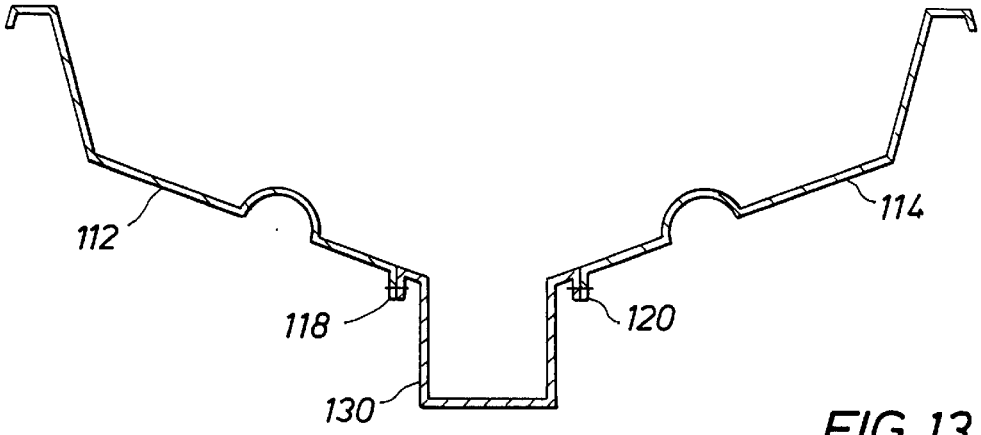
FIG. 13 is a section view of the present invention in which the removable insert provides a keel well for accommodating a keel of a boat.
Figure 14:
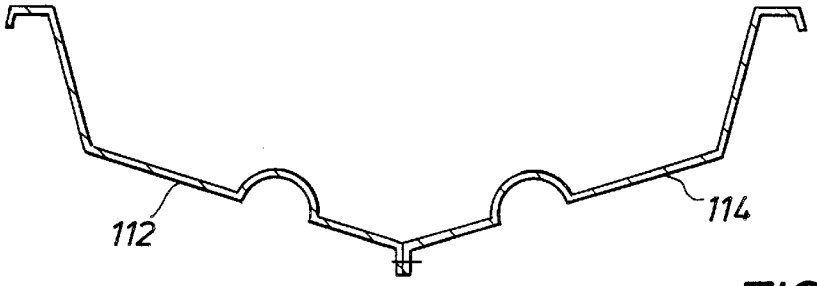
FIG. 14 is a section view of the present invention in which the removable insert of FIG. 12 or FIG. 13 has been removed.

To begin raising the dry dock system 10, water is blown out of the ballast tanks 14, as shown in FIG. 4. Blowing air into the ballast tanks 14 displaces the water from the ballast tanks, and thus raises the dry dock system 10 until boat supporting pads 56 (see FIG. 9) make contact with the bottom of the boat 8, at which point the upper edges or gunwales 13 of the basin 12 penetrate the waterline 32, as shown in FIG. 5. In a preferred embodiment, the supporting pads 56 are omitted and a boat 8 is supported within the dry dock by longitudinal runners, another feature of the present invention. This feature is shown in FIGS. 12, 13, and 14, and described below.

Figure 6:
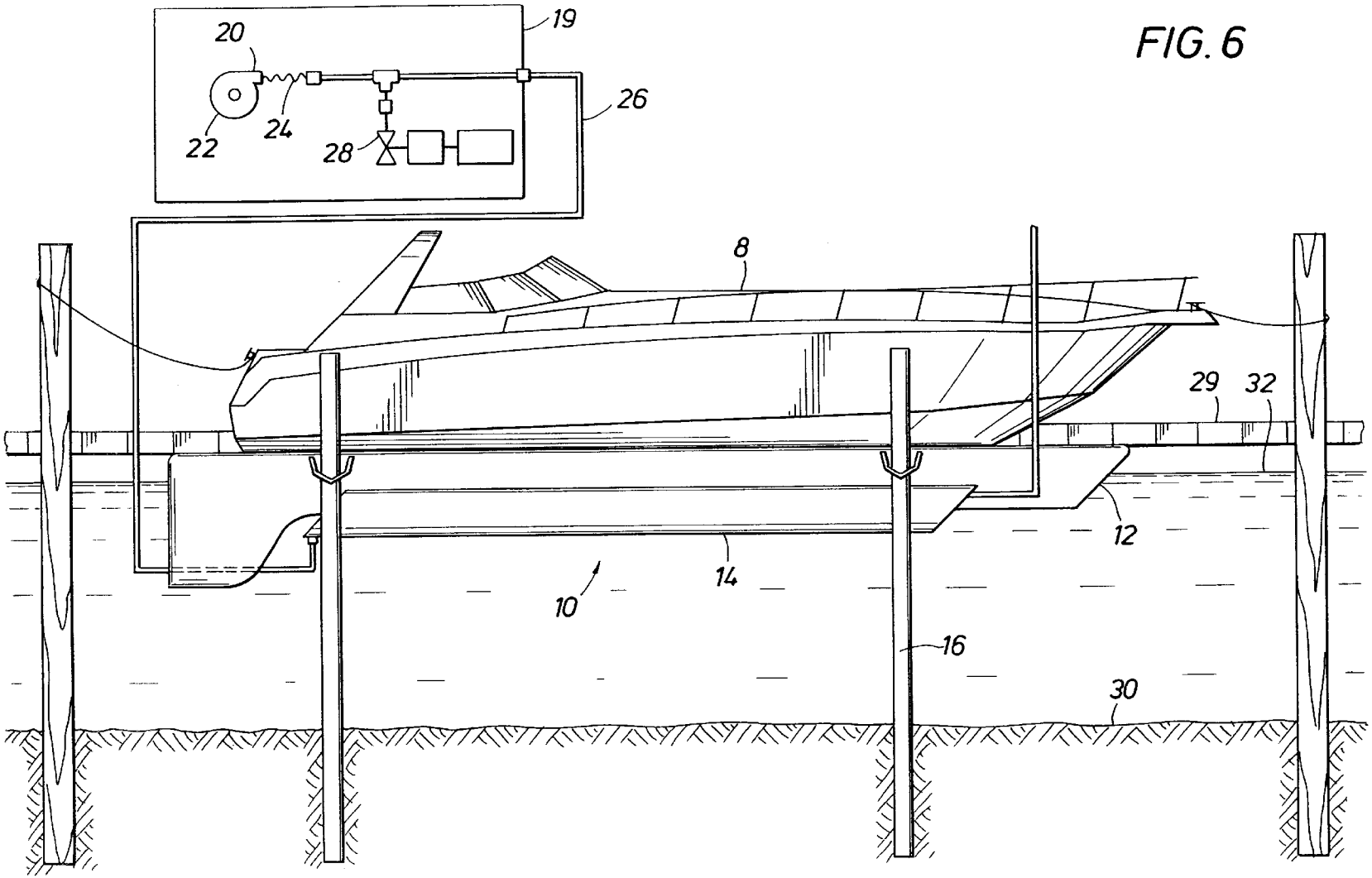
FIG. 6 is a side view of the dry docking system fully raised and deballasted and supporting the boat.

To complete the dry docking process, the water remaining in the basin 12 is pumped out by the pump or pumps 86, leaving the boat 8 in the dry dock position with the basin 12 and ballast tank 14 evacuated sufficiently empty of water to enable the boat to be dry docked, as shown in FIG. 6. The boat remains in this position until the use of the boat is needed or maintenance is complete. The process is then reversed to put the boat back in the water.

This system permits storage of a boat in a relatively benign environment. Because of the simplicity of the operation and the relatively small size of the present invention, this dry dock can be used on a routine basis as opposed to the typical commercial dry docking systems found in repair facilities which require large structural lifting components and frames.

As shown in FIGS. 1 and 5, the ballast tanks 14 may be attached to the basin 12 by gussets 54, or by bolting or strapping in a manner known in the art. The diameter and length of a ballast tank system 14 in a preferred embodiment is determined by the submerged weight of the basin 12. The ballast tank 14 may be made from any appropriate weather and corrosion resistant material, such as polyvinyl chloride (PVC) pipe or fiberglass, either wound or layered. The guide pins 16 may be made from plastic pipe such as PVC pipe or fiberglass, either wound or layered. The diameter of the guide pins is a function of the water depth and may be adapted to a specific locality or application for safe operation. The ballast tanks 14 may be mounted on both sides of the basin 12 toward the bottom of basin 12 as shown in FIG. 5. Multiple tanks can be installed such as the two shown in FIG. 5 and can be connected in series by well known methods.

Figure 8:
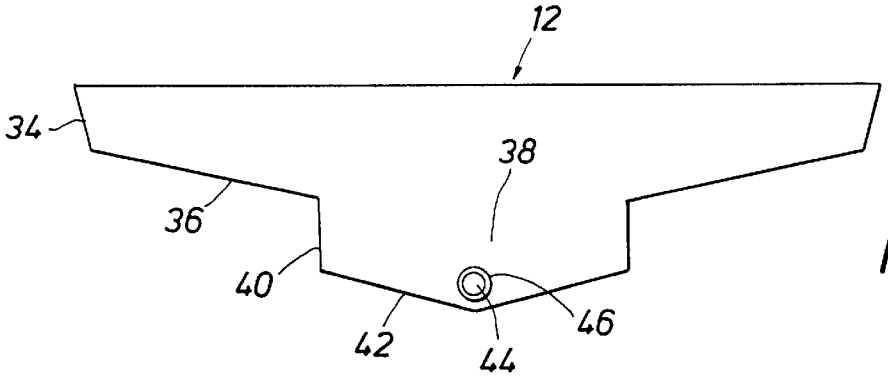
FIG. 8 is a transverse cross section across the basin of the dry docking system.
Figure 9:
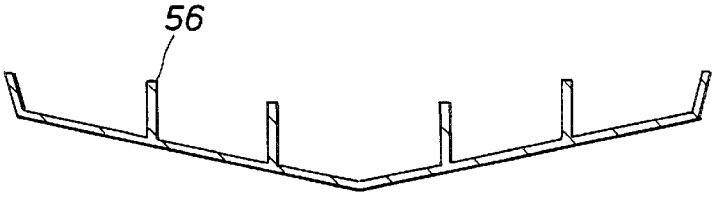
FIG. 9 is a transverse cross section of the basin of the dry docking system showing an alternative embodiment of supporting structures on the basin.
Figure 7:
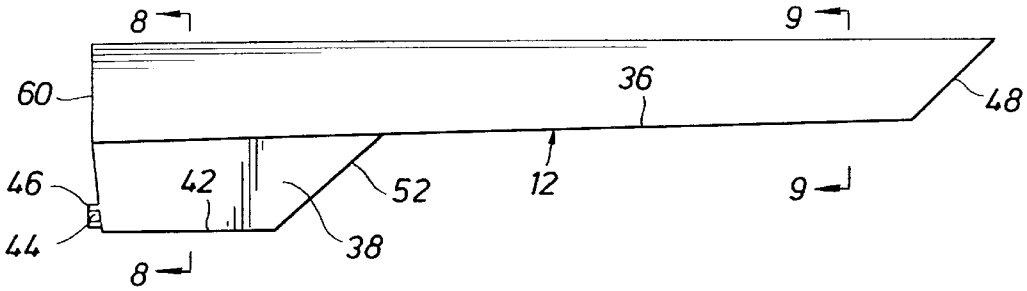
FIG. 7 is a longitudinal cross section of the basin of the dry dock system.

FIGS. 7, 8, and 9 depict a one-piece molded structure for the basin 12. However, it should be understood that the presently preferred embodiment includes a removable insert along the centerline, as described below with regard to FIGS. 12, 13, and 14.

The basin 12 may be made of fiberglass material or other structural material in a typical thickness of ⅜–½ inch, as desired. As shown in FIG. 7, the basic configuration of the basin 12 is defined by a bow 48, a stern 50, a bottom 36, and sides 34. FIG. 8 depicts a cross section of the stern portion of the basin as depicted in FIG. 7. The basin 12 also includes a lower cavity 38 which is formed by a front sloping surface 52, the stern 50, cavity sides 40, and a cavity bottom 42. A hole 44 in the stern 50 is formed by molding a coupling 46 into the stern 50. The hole 44 provides an access for flooding the basin. The cavity 38 provides clearance for outboard engines' drive shafts, water intakes, or propellers on the boat 8. The bottom 36 preferably slopes inwardly towards the longitudinal centerline of the basin 12.

Likewise, the cavity bottom 42 preferably slopes inwardly towards the longitudinal center of cavity 38. The bottom 36 may also be shaped to slope toward the stern 50 like the cavity bottom 42 and the sloping surface 52. These slopes move the water draining from basin 12 toward stern 50 for pumping out the basin. Attached to the coupling 46 is the basin pipeline 26, as shown in FIG. 1.

The basin 12, and specifically the bottom 36 in the cavity 38, may be contoured to fit the bottom of the boat 8. This contour allows a distributed force across the surface of the basin 12. Alternatively, a plurality of supporting and anti-fouling pads 56, as shown in FIG. 9, help support the bottom of the boat 8.

To summarize, to use the system of FIG. 10 to dry-dock a boat, the system is initially sunk to a depth sufficient to permit a boat to be driven or floated over the dry dock, usually on the bottom in shallow water. This accomplished by flooding the basin and filling the ballast tanks, as described. With a boat then positioned over the dry dock, air is blown into the ballast tanks until air vents out the blow holes. The dry dock will rise due to its buoyancy until the upper edges of the basin break the surface and zero buoyancy is achieved. Then, the bilge pumps pump out the water in the basin until the boat is supported entirely by the dry dock in a dry condition. To launch the boat, the basin flood valve is opened and the basin is flooded. At this point in the procedure, the boat may or may not be floating free of the dry dock. Finally, air is vented from the ballast tanks and the dry dock is sunk to a point where the boat can be floated clear of the dry dock.

Figure 11:
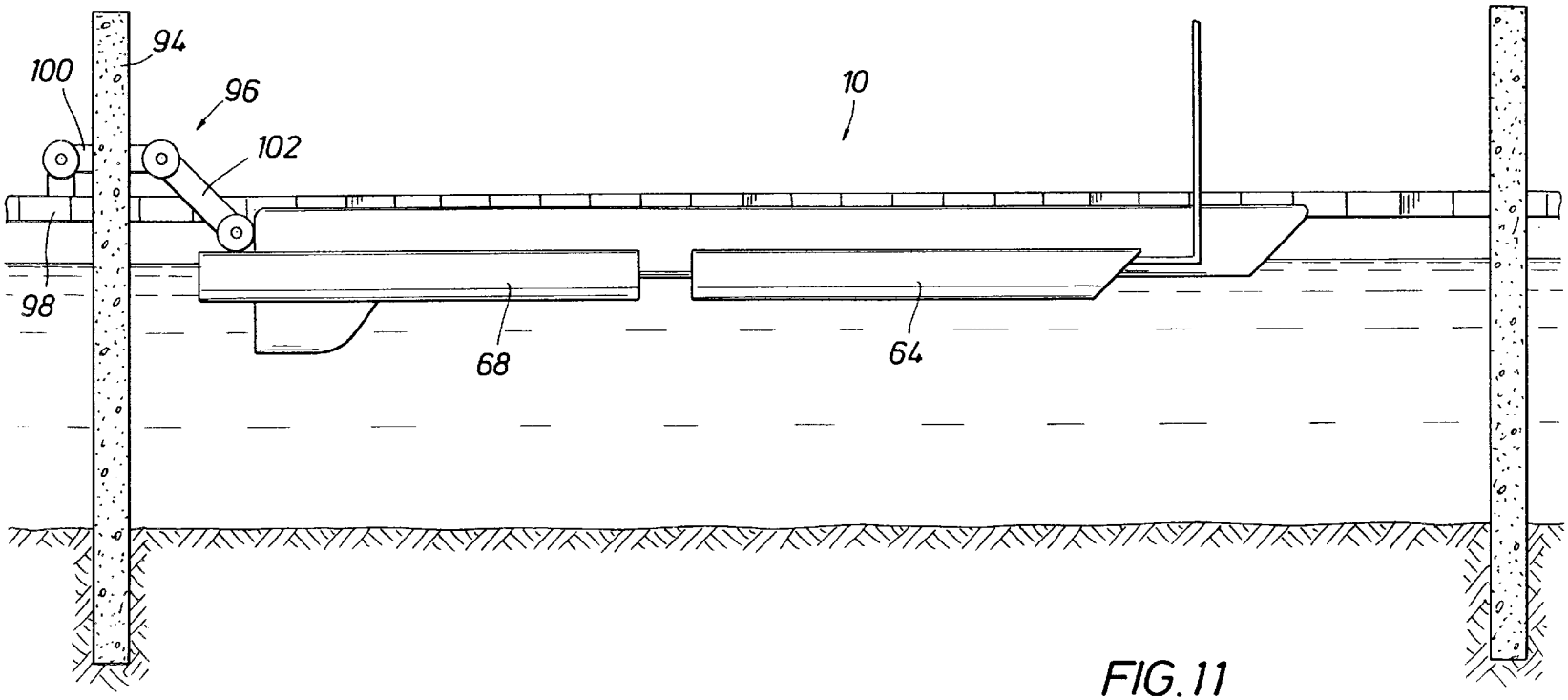
FIG. 11 is a side view of an embodiment of the present invention to show permanent mounting of the present invention to a solid pier.

Next, FIG. 11 illustrates an embodiment of the present invention that is particularly useful where the dry dock system can remain attached to a solid pier, such as a concrete pier 94. In this case, an articulated alignment system 96 is solidly mounted to a deck 98 and a plurality of articulated arms 100 and 102 maintain the dry dock system 10 in horizontal relationship with the pier.

FIGS. 12, 13, and 14 depict a presently preferred embodiment of a dry-dock hull 110 of the present invention. The views of FIGS. 12, 13, and 14 corresponds roughly to the view of FIG. 9. The dry-dock hull or basin comprises primarily a port hull half 112, a starboard hull half 114, and an insert 116. The port hull half 112 and the insert 116 or 130 are releasably joined at a flange 118, while the starboard hull half 114 and the insert are releasably joined at a flange 120. Those of skill in the art will appreciate that a single flange could be used at a low point 122, as shown in FIG. 14, eliminating the insert and fully within the scope of the present invention; however, this is not preferred since this eliminates the feature of the flexible insert as well as the ability to adapt the dry-dock to narrow boats. However, the identical port hull half 112 and starboard hull half 114 may be employed and the insert removed, as shown in FIG. 14, and thus accommodate long and narrow craft.

The insert 116 or 130 may be formed of the same material as the rest of the hull but can be formed of a flexible polymeric material to absorb the crushing forces of ice formed around the dry-dock in northern waters, as shown schematically by arrows 124.

The embodiment of FIG. 12 further depicts another feature of the present invention, a pair of longitudinal runners 126, which support a hull 128 of a boat. The runners 126 may be integrally formed with the hull of the dry-dock, as shown, or adhered to the hull by any appropriate manner known in the art.

FIG. 13 depicts an additional feature of the present invention. A keel well 130 of an appropriate depth and width is provided, in place of the chevron shaped insert of FIG. 12. This enables the dry-dock to accept fixed-keel boats, such as some sailboats and others. The keel well 130 may also be made of a flexible polymeric material to absorb ice floe pressures.

While the above embodiments are illustrative of the invention and have been described with particularity, it will be understood that variations and modifications will be apparent and can be readily made by those skilled in the art without departing from the spirit and scope of the invention. For example, those of skill in the art will immediately recognize that the structure of the present invention is easily adaptable to accommodate a sailboat with a fixed keel, and is fully within the scope and spirit of the present invention.

We claim:

1. A dry dock comprising:

(a) a floodable basin, the basin comprising
  i. a port hull half; and
  ii. a starboard hull half releasably engageable with the port hull half at a seam therebetween;

(b) a ballast tank coupled to the basin;

(c) a water source to the ballast tank to selectively admit water into the ballast tank;

(d) a vent from the ballast tank to allow air to be removed from the ballast tank; and (e) a guide means for fixing the spatial relationship between the dry dock system and a boat-slip and for guiding the dry dock system for vertical movement.

2. The dry dock of claim 1 wherein the guide means comprises a plurality of guide pins slidably engaged with the basin through guide brackets.

3. The dry dock of claim 1 wherein the guide means comprises an articulated arm rotatably mounted to a pier adjacent the dry dock and coupled to the basin.

4. The dry dock of claim 1 further comprising a source of pressurized air coupled to the ballast tank to selectively force water from the ballast tank.

5. The dry dock of claim 1 wherein the seam comprises a removable insert.

6. The dry dock of claim 5 wherein the removable insert comprises a keel well.

7. The dry dock of claim 5 wherein the insert is made of a flexible polymeric material.

8. The dry dock of claim 1 wherein the basin defines a forward end and an after end and wherein the ballast tank comprises a forward tank element adjacent the forward end of the basin and an after tank element adjacent the after end of the basin.

9. The dry dock of claim 1 wherein basin defines a port side and a starboard side and the ballast tank comprises a port ballast tank element adjacent the port side of the basin and a starboard ballast tank element adjacent the starboard side of the basin.

10. A method for storing boats out of water comprising the steps of:

(a) positioning a boat over a submerged dry dock having a basin with an upper rim and a ballast tank filled with water, the basin comprising;
  i. a port hull half; and
  ii. a starboard hull half releasably engageable with the port hull half at a seam therebetween;

(b) forcing air into the ballast tank, thereby displacing water from the ballast tank;

(c) raising the dry dock until the upper rim broaches the surface of the water in which the dry dock is submerged;

(d) engaging the boat's bottom exterior surface with the dry dock; and (e) pumping water out of the basin.

11. The method of claim 10 further comprising the step of positioning a guide means adjacent the basin to control the horizontal position of the dry dock as it is moved in a vertical direction.

12. A dry dock comprising:

(a) a hollow basin comprising a port hull half and a starboard hull half abutting at a seam therebetween;

(b) a guide means for fixing the spatial relationship between the dry docking system and a boat-slip;

(c) a source of compressed air coupled to the basin;

(d) a means for transferring air from the air source to the basin; and (e) vent means for evacuating the air from the basin.

13. The apparatus of claim 12 wherein the seam comprises a removable insert.

14. The apparatus of claim 13 wherein the insert is made of a flexible polymeric material.

15. The apparatus of claim 13 wherein the insert comprises a keel well.

* * * * *